US005312492A

United States Patent [19]

Riesop et al.

[11] Patent Number: 5,312,492

[45] Date of Patent: May 17, 1994

[54] PROCESS NOT USING CHLORATE OR NITRITE FOR THE PRODUCTION OF NICKEL AND MANGANESE CONTAINING ZINC PHOSPHATE FILMS

[75] Inventors: Joerg Riesop, Niederzier; Kurt Hosemann, Cologne; Karl-Heinz Gottwald, Erftstadt, all of Fed. Rep. of Germany

[73] Assignee: Henkel Kommanditgesellschaft auf Aktien, Fed. Rep. of Germany

[21] Appl. No.: 768,692

[22] PCT Filed: Apr. 14, 1990

[86] PCT No.: PCT/EP90/00592

§ 371 Date: Dec. 10, 1991

§ 102(e) Date: Dec. 10, 1991

[87] PCT Pub. No.: WO90/12901

PCT Pub. Date: Nov. 1, 1990

[30] Foreign Application Priority Data

Apr. 21, 1989 [DE] Fed. Rep. of Germany ..... 3913089

[51] Int. Cl.[5] ..... C23C 22/18

[52] U.S. Cl. ..... 148/260; 148/262

[58] Field of Search ..... 148/262, 260

[56] References Cited

U.S. PATENT DOCUMENTS 4,419,199 12/1983 Hauffe ..... 148/260
4,950,339 8/1990 Gehmecker ..... 148/262
4,968,360 11/1990 Hoseman ..... 148/262

FOREIGN PATENT DOCUMENTS 1184590 12/1964 Fed. Rep. of Germany ..... 148/260

OTHER PUBLICATIONS

EP-0228151.

*Primary Examiner*—Sam Silverberg
*Attorney, Agent, or Firm*—Ernest G. Szoke; Wayne C. Jaeschke; Norvell E. Wisdom, Jr.

[57] ABSTRACT

The invention concerns a process, not using chlorate or nitrite, for the production of nickel and manganese containing zinc phosphate films on steel, zinc, and/or zinc alloys by spraying, spray-dipping, and/or dipping, using an aqueous solution. An organic oxidizing agent is added, primarily to depolarize the nascent hydrogen produced.

6 Claims, No Drawings

PROCESS NOT USING CHLORATE OR NITRITE FOR THE PRODUCTION OF NICKEL AND MANGANESE CONTAINING ZINC PHOSPHATE FILMS

BACKGROUND OF THE INVENTION

1. Field of the Invention

This invention relates to a process for phosphating metal surfaces and, more particularly, to a process for the production of manganese- and nickel-containing zinc phosphate coatings on steel, zinc, and/or alloys thereof. These nickel- and manganese-containing zinc phosphate coatings are applied by spray coating, spray/dip coating and dip coating with aqueous solutions.

Processes for phosphating surfaces of iron, steel, zinc and alloys thereof and also aluminum have long been known (*Ullmanns Encyklopadie der technischen Chemie,* 4th Edition, Vol. 15, pages 686 and 687). The object of phosphating the surfaces mentioned is to increase the adhesive strength of paint films and to improve protection against corrosion.

Acidic zinc and alkali metal phosphate solutions have acquired the greatest significance for phosphating processes. Zinc phosphating baths may contain, for example, monozinc phosphate, free phosphoric acid, zinc nitrate and oxidizing agents as their principal components. The pH value of such solutions is typically in the range from 2.8 to 3.4. The process essentially comprises two reactions, namely: the pickling reaction and the formation of a zinc phosphate coating on the surface to be phosphated.

Manganese-modified zinc phosphate coatings as a primer for modern paints are known from W.A. Roland and K.-H. Gottwald, *Metalloberflache,* Vol. 42, 1988/6. According to this publication, the use of manganese ions in addition to zinc and nickel ions in low-zinc phosphating processes demonstrably improves protection against corrosion, particularly where surface-treated fine metal sheets are used. The incorporation of manganese in the zinc phosphate coatings leads to relatively small and relatively compact crystals showing increased stability to alkalis. At the same time, the operating range of phosphating baths is increased; even aluminum in conjunction with steel and galvanized steel can be phosphated to form coatings for which the quality standard generally reached is guaranteed.

Phosphating with addition of oxidizing agents has long been practiced in the automotive industry. By contrast, in the cold-forming field, several processes are operated on the iron side, i.e. with an increased content of iron(II) and no addition of oxygen-yielding accelerators.

The disadvantage of conventional phosphating baths lies in particular in the use of nitrites and/or chlorates as accelerators for the phosphating reaction. The nitrous gases formed where nitrites are used are known to have adverse effects on the usefulness of such baths.

2. Description of the Invention

The problem addressed by the present invention was to provide a nitrite-free and also chlorate-free phosphating process which, in particular, causes no so-called "fish eyes". Fish eyes are understood on the one hand to be buildups of zinc salts which are known in English as "white staining" and which are caused by the cleaning solution. On the other hand, crater-like openings known in English as "nubbing" are formed during phosphating.

The systems normally used contain chlorate, bromate, nitrate, nitrite, peroxide and/or organic nitro compounds, such as 3-nitrobenzene sulfonate, as accelerators. Hitherto, 3-nitrobenzene sulfonate has generally been used together with chlorate and/or nitrite accelerators. In the presence of nitrate, however, the system normally used, 3-nitrobenzene sulfonic acid/chlorate, produces the above-mentioned fish eyes on electrolytically galvanized steel, so that phosphating normally has to be carried out in the absence of nitrate.

SUMMARY OF THE INVENTION

The problem stated above has been solved by a chlorate-free and nitrite-free process for the production of nickel- and manganese-containing zinc phosphate coatings on steel, zinc and/or alloys thereof by spray coating, spray/ dip coating, and/or dip coating with an aqueous solution containing 0.3 to 1.5 g/1 zinc(II), 0.01 to 2.0 g/1 manganese(II), 0.01to 0.8 g/1 iron(II), 0.3 to 2.0 g/1 nickel(II), 10.0 to 20.0 g/1 phosphate ions, 2.0 to 10.0 g/1 nitrate ions and 0.1 to 2.0 g/1 of an organic oxidizing agent, the aqueous solution having a content of free acid of 0.5 to 1.8 points and a total acid content of 15 to 35 points and $Na^+$being present in the quantity required to establish the free acid content.

DESCRIPTION OF PREFERRED EMBODIMENTS

Accordingly, the present invention provides a low-zinc process which is characterized by a defined content of iron(II). Through the contact of the bath solution with atmospheric oxygen during circulation and spraying, the iron(II) is partly oxidized to iron(III) and removed from the system as iron phosphate sludge.

If, in certain types of installation, the iron(II) content rises beyond the claimed level of 0.8 g/1, the desired iron(II) content can be established by the oxidation of iron(II) to iron(III) through the controlled addition of hydrogen peroxide and/or potassium permanganate in the sludge elimination system.

The particular advantage of the process according to the invention is that, providing the maximum limits mentioned for iron(II) are observed and a single accelerator, namely an organic oxidizing agent, is used, no nitrous gases are formed. In addition, the serious problems normally involved in the use of nitrate-free phosphating baths do not occur where the process according to the invention is applied. In the application of the process according to the invention, the iron(II) concentration is determined continuously and/or discontinuously. Analytical determinations such as these are known to the expert. By using oxidizing agents, particularly in the sludge elimination system, an excessively high iron(II) concentration can be regulated by formation of iron(III). Accordingly, exact control of the iron(II) content is a highly critical aspect of the present invention.

Accordingly, the present invention provides a zinc phosphating process which may be used in particular in the low-zinc range. Phosphate coatings containing nickel and manganese in addition to zinc and iron as cations are produced by this process.

According to the invention, the organic oxidizing agent to be used is selected so that it makes very little contribution, if any, to the oxidation of iron(II) to iron(III). Instead, it is mainly used to depolarize the nascent hydrogen.

In one preferred embodiment of the present invention, the chlorate- and nitrite-free process for the production of zinc phosphate coatings on steel, zinc and/or alloys thereof by dip coating, spray/dip coating and/or dip coating with an aqueous solution is modified by the use of an aqueous solution containing 0.8 to 1.0 g/l zinc(II), 0.8 to 1.0 g/l manganese(II), 0.2 to 0.4 g/l iron(II), 0.5 to 0.7 g/l nickel(II), 12.0 to 16.0 g/l phosphate ions, 3.0 to 6.0 g/l nitrate ions and 0.3 to 0.8 g/l of an organic oxidizing agent. The free acid content and the total acid content correspond to the values mentioned above, as does the quantity of sodium.

In one preferred embodiment of the present invention, 3-nitrobenzene sulfonic acid is used as the organic oxidizing agent.

Another preferred embodiment of the invention is characterized in that the upper limit to the concentration of iron(II) in the aqueous solution is at or below 0.3 g/l. Atmospheric oxygen is mainly used for this purpose, although other oxidizing agents, such as hydrogen peroxide, oxygen, and/or potassium permanganate, may also be used in principle.

The sodium salt of 3-nitrobenzene sulfonic acid is preferably used as the organic oxidizing agent.

EXAMPLES OF BATH COMPOSITIONS

Within the usual sequence of process steps, namely:

1. Cleaning and degreasing:

Use of surfactant-containing alkaline cleaning solutions applied by spraying and/or dipping (for example RIDOLINE C1250) for 1 to 5 minutes at 50° to 60° C.

2. Rinsing

3. Activation:

Use of preparations containing titanium salts (for example FIXODINE C9112) applied separately by spraying or dipping for 30 to 180 s at 20° to 40° C. The activation stage may be omitted if this activating agent is added to the cleaning stage.

4. Phosphating:

For composition, see Table 1.

5. Rinsing

6. After-passivation:

Use of chromium-containing or chromium-free post-passivating agents (for example DEOXYLYTE 41 or 80) applied by spraying or dipping for 30 to 180 s at 20° to 50° C.

7. Rinsing with deionized water, surface treatment was carried out under the following conditions:

TABLE 1

| Bath parameters | Phosphating Method of application: Spray coating (A) | Spray/dip coating (B) | Dip coating (C) |
|---|---|---|---|
| FA[1] (points) | 0.7 | 1.1 | 1.3 |
| TA[2] (points) | 20 | 22 | 26 |
| $Zn^{2+}$ $gl^{-1}$ | 0.8 | 0.9 | 1.0 |
| $Mn^{2+}$ $gl^{-1}$ | 0.8 | 0.8 | 0.8 |
| $Ni^{2+}$ $gl^{-1}$ | 0.6 | 0.6 | 0.6 |
| $Fe^{2+}$ $gl^{-1}$ | 0.2 | 0.2 | 0.3 |
| $PO_4^{3-}$ $gl^{-1}$ | 12.6 | 14.0 | 15.8 |
| NBS[3] $gl^{-1}$ | 0.3 | 0.4 | 0.5 |
| Temp. °C. | 50 | 52 | 54 |
| Time s | 90 | 30 S/180 D | 180 |

[1]FA = free acid
[2]TA = total acid
[3]NBS = 3-nitrobenzene sulfonic acid, Na salt Weights per unit area of the phosphate coating of 1.3 to 2.5 $gm^{-2}$ were produced with the above-mentioned variants of spray coating (A), spray/dip coating (b) and dip coating (c). In method of application (B), dip coating was carried out for 180 s after spraying for 30 s.

The iron(II) content in the bath solution was kept below the values shown in Table 1 by means of oxidizing agents, such as hydrogen peroxide, potassium and/or sodium permanganate, ozone, oxygen and/or atmospheric oxygen, which were added continuously or discontinuously in the quantities required to adjust the iron(II) concentration.

Steel plates (quality St.1405) treated by method of application B show the following layer composition: 52% hopeite (including $Zn_2Mn(PO_4)_2 \times 4\ H_2O$) 48% phosphophyliite. Metal sheets treated by methods (B), spray coating, and (C), dip coating, were subjected to corrosion tests in accordance with the VW standard P 1210; alternating climate, test period 30/60 days: (The paint used was the standard cathodic electrodeposition primer FT 85 7042 manufactured by BASF Farben und Lacke.)

Method of application B

| | 30 days | | | 60 days | | |
|---|---|---|---|---|---|---|
| | CRS[1] | Z[2] | ZE[3] | CRS | Z | ZE |
| Surface acc. to DIN 53209[4] | m0/g0 | m0/g0 | m0/g0 | m0/g0 | m0/g0 | m0/g0 |
| Cutting acc. to DIN 53167 in mm | 0.3 | 0.7 | 0.7 | 0.5 | 1.0 | 1.1 |
| Chipping behavior acc. to VW standard | K 2 | K 4 | K 2 | K 3 | K 7 | K 2 |

Method of application C

| | 30 days | | | 60 days | | |
|---|---|---|---|---|---|---|
| | CRS[1] | Z[2] | ZE[3] | CRS | Z | ZE |
| Surface acc. to DIN 53209[4] | m0/g0 | m0/g0 | m0/g0 | m0/g0 | m0/g0 | m0/g0 |
| Cutting acc. to DIN 53167 in mm | 0.3 | 0.4 | 0.5 | 0.5 | 0.6 | 0.5 |
| Chipping behavior acc. to VW standard | K 2 | K 3 | K 1 | K 3 | K 6 | K 2 |

[1]CRS = cold-rolled steel St 1405
[2]Z = hot-galvanized steel, 10 μm coating on both sides
[3]ZE = electrolytically galvanized steel, 7.5 μm coating on both sides
[4]Ratio of degree of blistering to blister size.

In determination of the degree of blistering of paints in accordance with DIN53 209, the blistering which occurs in paints is defined by indication of the degree of blistering. According to this standard, the degree of blistering is a measure of the blistering which has occurred in a paint according to the frequency of the blisters per unit area and the size of the blisters. The degree of blistering is expressed by a code letter and a code number for the frequency of the blisters per unit area and by a code letter and a code number for the size of the blisters. The code letter and the code number m0 mean no blisters while m5 defines a certain frequency of the blisters per unit area in accordance with the degree of blistering patterns of DIN 53 209.

The size of the blisters is denoted by the code letter g and a code number in the range from 0 to 5. The code letter and code number g0 mean "no blisters" while g5 corresponds to the size of the blisters in accordance with the degree of blistering patterns of DIN 53 209.

By comparing the paint with the degree of blistering patterns, it is possible to determine the degree of blistering for which the pattern is most similar to the appearance of the paint.

According to DIN 53 167, the salt spray test according to this standard is used to determine the behavior of lacquers, paints and similar coatings under the effect of sprayed sodium chloride solution. If the coating has any weak spots, pores or damage, the sodium chloride solution creeps beneath the coating from those defects, resulting in a reduction or loss of adhesion and in corrosion of the metallic substrate.

The salt spray test is used to reveal such defects so that any creepage can be detected.

In the context of this standard, creepage is understood to be the penetration of sodium chloride solution from a point of intentional damage (scratch) or from existing weak spots (for example pores, edges) to the interface between the coating and the substrate or into the interface between individual coatings. The width of the zone with reduced or lost adhesion is a measure of the resistance of the coating on the particular substrate to the effect of sprayed sodium chloride solution.

The VW standard P-VW 1210 is an alternating test consisting of a combination of various standard tests. Thus, in the present case, a 30/60 day test cycle consists of salt spray testing for 4 h in accordance with DIN 50 021, standing for 4 h at room temperature, and testing for 16 h in a constant condensed moisture atmosphere in accordance with DIN 50 017.

At the beginning of the test, the test specimen is bombarded with a certain quantity of steel shot having a certain particle size distribution. After the test period, a characteristic value is assigned to the degree of corrosion.

In accordance with code numbers of 1 to 10, the code number 1 stands for no visible corrosion while the code number 10 means that virtually the entire surface is corroded.

What is claimed is:

1. A chlorate-free and nitrite-free process for the production of nickel- and manganese-containing zinc phosphate coatings on steel, zinc, or alloys thereof, said process comprising spray coating, spray coating and dip coating, or dip coating the steel, zinc, or alloys thereof with an aqueous solution containing 0.8 to 1.0 g/1 of zinc(II), 0.8 to 1.0 g/1 of manganese(II), 0.2 to 0.4 g/1 of iron(II), 0.5 to 0.7 g/1 of nickel(II), 12.0 to 16.0 g/1 of phosphate ions, 3.0 to 6.0 g/1 of nitrate ions and 0.3 to 0.8 g/1 of 3-nitrobenzene sulfonic acid, the aqueous solution having a free acid content of 0.5 to 1.8 points and a total acid content of 15 to 35 points and the quantity of $Na^+$ required to establish the free acid content.

2. A process as claimed in claim 1, wherein the aqueous solution contains 0.3 g/1 or less of iron(II).

3. A process as claimed in claim 2, wherein the sodium salt of 3-nitrobenzene sulfonic acid is used as the organic oxidizing agent.

4. A process as claimed in claim 3, wherein the iron(II) content is adjusted during the process by oxidizing agents selected from the group consisting of atmospheric oxygen, oxygen, hydrogen peroxide, and potassium permanganate.

5. A process as claimed in claim 1, wherein the sodium salt of 3-nitrobenzene sulfonic acid is used as the organic oxidizing agent.

6. A process as claimed in claim 2, wherein the iron(II) content is adjusted during the process by oxidizing agents selected from the group consisting of atmospheric oxygen, oxygen, hydrogen peroxide, and potassium permanganate.

* * * * *